US007475562B2

(12) United States Patent
Jackovin

(10) Patent No.: US 7,475,562 B2
(45) Date of Patent: Jan. 13, 2009

(54) ICE STORAGE DRAWER FOR A BOTTOM MOUNT REFRIGERATOR

(75) Inventor: Gary B. Jackovin, Ankeny, IA (US)

(73) Assignee: Maytag Corporation, Benton Harbor, MI (US)

( * ) Notice: Subject to any disclaimer, the term of this patent is extended or adjusted under 35 U.S.C. 154(b) by 484 days.

(21) Appl. No.: 11/320,480

(22) Filed: Dec. 29, 2005

(65) Prior Publication Data

US 2007/0151281 A1 Jul. 5, 2007

(51) Int. Cl.
*F25C 5/18* (2006.01)

(52) U.S. Cl. ..... 62/344; 62/382; 62/441; 312/404

(58) Field of Classification Search ..... 62/340–356, 62/440–441, 382; 312/404
See application file for complete search history.

(56) References Cited

U.S. PATENT DOCUMENTS

| | | | | |
|---|---|---|---|---|
| 3,077,749 | A * | 2/1963 | Jung et al. | 62/414 |
| 3,089,312 | A * | 5/1963 | Harle | 62/135 |
| 3,163,025 | A * | 12/1964 | Dahlgren | 62/177 |
| 3,247,682 | A * | 4/1966 | Jacobs | 62/344 |
| 3,744,270 | A * | 7/1973 | Wilcox | 62/344 |
| 3,798,923 | A * | 3/1974 | Pink et al. | 62/266 |
| 4,007,602 | A * | 2/1977 | Maxwell et al. | 62/137 |
| 6,637,235 | B2 | 10/2003 | Sakamoto et al. | |
| 7,028,503 | B2 * | 4/2006 | Lyvers et al. | 62/344 |
| 2003/0046947 | A1 | 3/2003 | Ohya et al. | |

FOREIGN PATENT DOCUMENTS

| | | | |
|---|---|---|---|
| GB | 2242731 | | 10/1991 |
| JP | 409145211 | A | 6/1997 |
| JP | 409152242 | A | 6/1997 |
| JP | 409178316 | A | 7/1997 |
| JP | 409257348 | A | 10/1997 |
| JP | 410160307 | A | 6/1998 |
| JP | 410160311 | A | 6/1998 |
| JP | 2002228312 | A | 8/2002 |
| JP | 2002228316 | A | 8/2002 |

* cited by examiner

*Primary Examiner*—William E Tapolcai
(74) *Attorney, Agent, or Firm*—Kirk Goodwin; Michael D. Lafrenz

(57) ABSTRACT

A bottom-mount refrigerator provides additional storage capacity by mounting a refrigeration component, for example a compressor, behind a full-width freezer drawer arranged between an upper fresh food compartment and a lower freezer compartment. In this manner, the freezer compartment is not required to be shortened or otherwise re-shaped to accommodate the refrigeration component. The refrigerator also includes an automatic ice maker mounted above the freezer drawer. The ice maker is positioned above the freezer drawer at a rearward position that accommodates structure present in the fresh food compartment. Specifically, a bi-level bin is slidably mounted in the fresh food compartment. The bin includes a deep portion that joins a shallow portion through a step section. The ice maker is mounted rearward of the step section to allow the bin to be removed from the fresh food compartment.

19 Claims, 2 Drawing Sheets

ICE STORAGE DRAWER FOR A BOTTOM MOUNT REFRIGERATOR

BACKGROUND OF THE INVENTION

1. Field of the Invention

The present invention pertains to the art of refrigerators and, more particularly, to an ice storage drawer arranged between a fresh food compartment and freezer compartment in a bottom mount refrigerator.

2. Discussion of the Prior Art

There exist various styles of refrigerators on the market. The most common styles are side-by-side, top mount, and bottom mount models. In a side-by-side model, fresh food and freezer compartments are arranged laterally adjacent one another. A top mount refrigerator includes an upper freezer compartment and a lower fresh food compartment. Finally, bottom mount models locate the fresh food compartment above the freezer compartment. In many cases, the freezer compartment in a bottom mount model is constituted by a pull-out drawer.

In bottom mount models, refrigeration components, typically a compressor and evaporator, are mounted in a lower portion of the refrigerator behind the freezer compartment. With this configuration, a bottom rear portion of the freezer compartment must be angled so as to allow room for the refrigeration components. Alternatively, an overall length of the freezer compartment can be reduced to accommodate the compressor or other refrigeration components. In either case, an overall storage volume of the freezer compartment is reduced. In addition to the compressor robbing space from the freezer compartment, there is also a need to incorporate an automatic ice maker, as well as provide ice storage which further reduces storage volume for consumer purchased food items.

Based on the above, there is seen to exist a need for a bottom mount refrigerator configuration that provides for a more efficient allocation of space. More specifically, there exists a need for a bottom mount refrigerator that includes a dedicated ice storage drawer and re-positioned refrigeration components to provide greater storage capacity in the freezer compartment.

SUMMARY OF THE INVENTION

The present invention is directed to a refrigerator including a cabinet having top, bottom, rear and opposing side walls within which is positioned first and second liners that define a fresh food compartment and a freezer compartment respectively. More specifically, the fresh food and freezer compartments are in vertical alignment, with the fresh food compartment being positioned above the freezer compartment so as to define a bottom mount style refrigerator. The refrigerator includes a crisper bin shiftably mounted within the fresh food compartment. Preferably, the crisper bin includes a forward or deep portion that leads to a rear or shallow portion through a step section. More preferably, the step section slopes rearward from the deep portion up to the shallow portion.

In accordance with the invention, the refrigerator also includes a freezer drawer shiftably mounted between the fresh food compartment and the freezer compartment. Preferably, the freezer drawer extends substantially an entire width of the cabinet and is provided with a plurality of dividers that establish various storage zones. The storage zones can be employed to store for example, ice cubes, frozen foods, frozen juice concentrate and the like. Towards that end, an automatic ice maker is arranged above the freezer drawer adjacent to at least one of the storage zones.

In accordance with the most preferred embodiment of the invention, the automatic ice maker is positioned rearward of the step section of the crisper bin. In this manner, the crisper bin can be readily accessed, i.e., slid completely into and out of the fresh food compartment without interference. Furthermore, in order to increase an overall storage capacity of the freezer compartment, required refrigeration components are positioned between the fresh food and freezer compartments. Most notably, a compressor is mounted behind the freezer drawer and a evaporator coil is positioned below the freezer drawer. With this configuration, the freezer compartment can extend substantially a full width and substantially a full depth of the cabinet.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
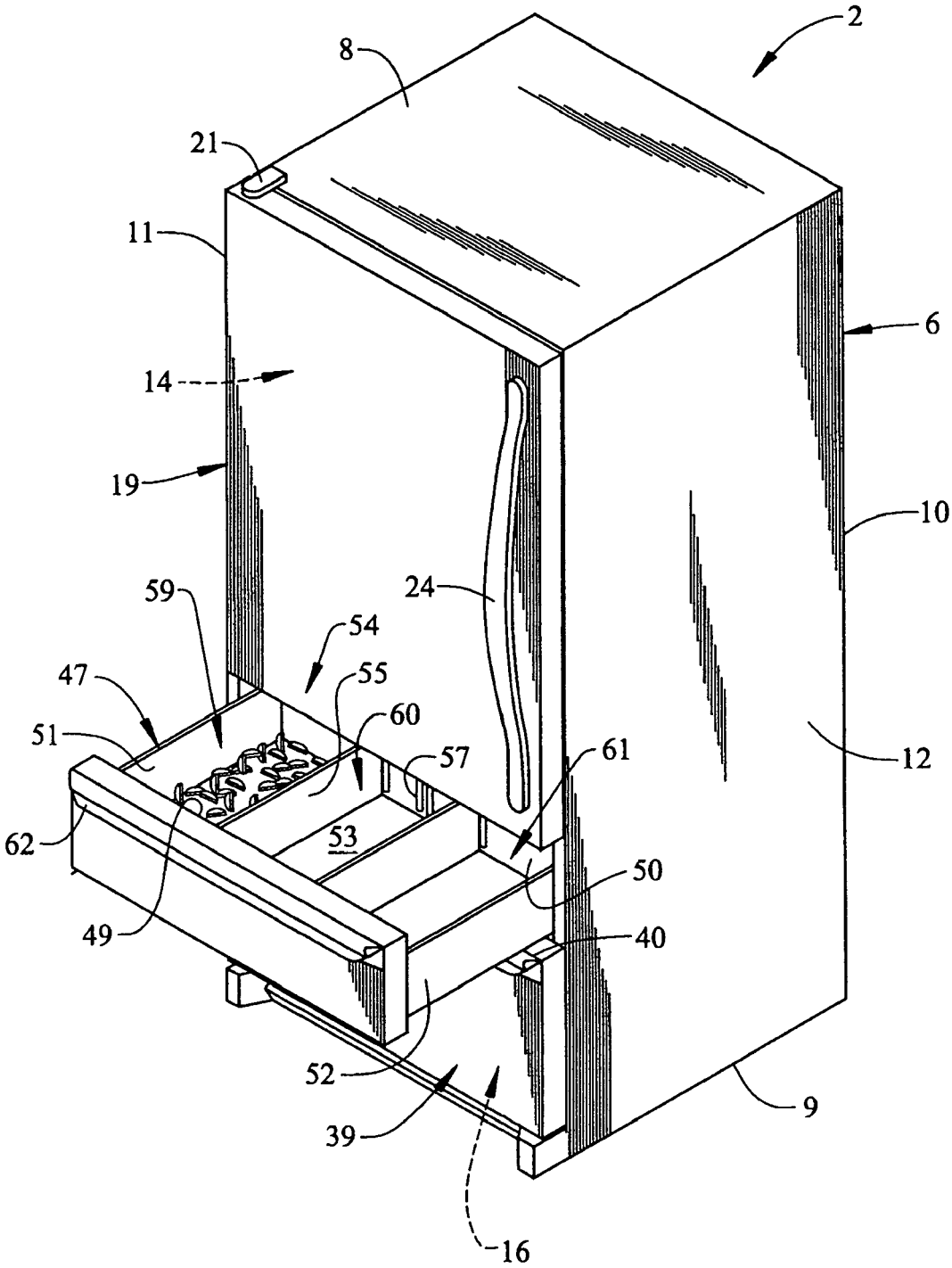
FIG. 1 is an upper right perspective view of a bottom mount refrigerator incorporating a freezer drawer constructed in accordance with the present invention.
Figure 2:
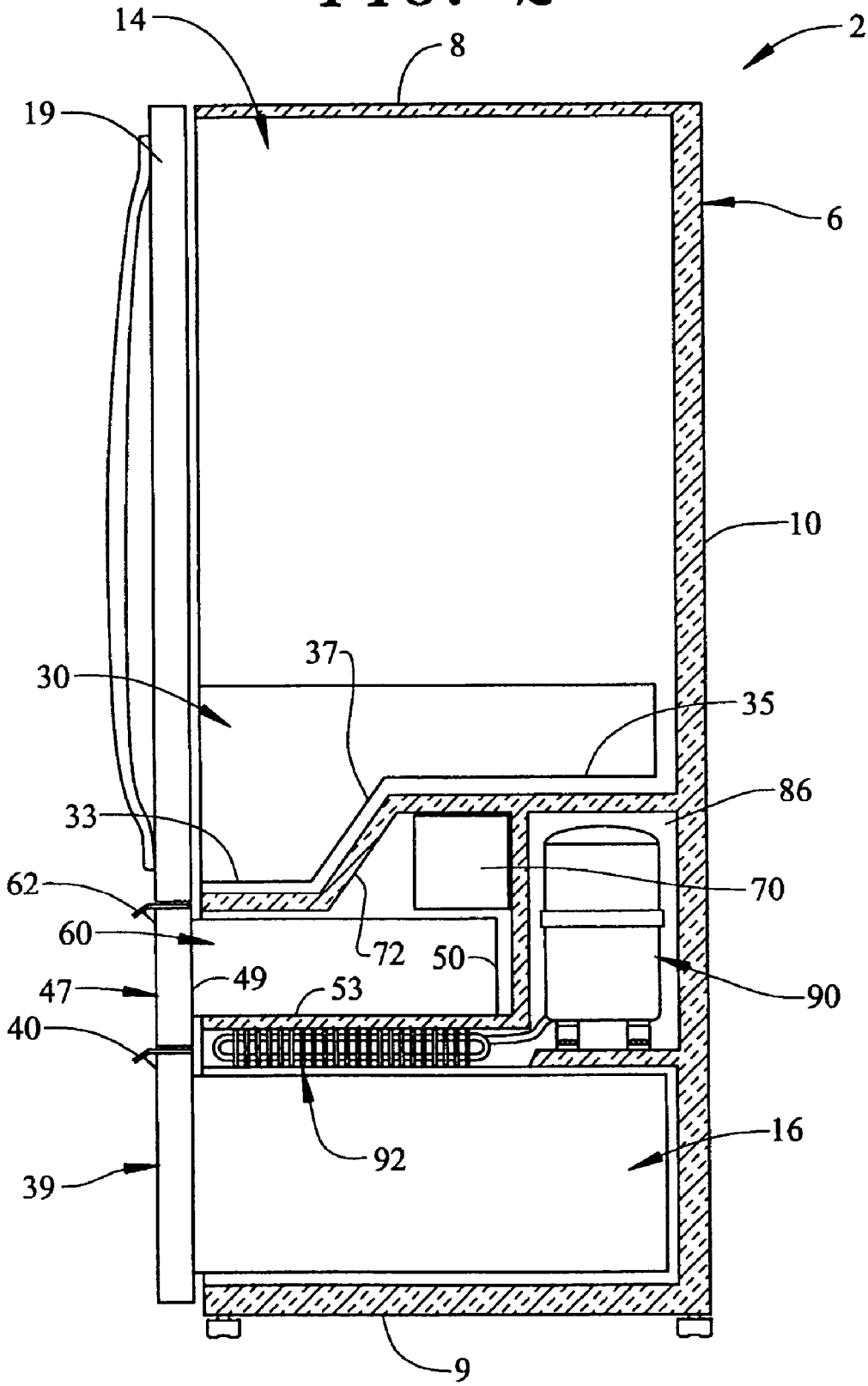
FIG. 2 is a cross-sectional side view of the bottom mount refrigerator of FIG. 1.

With reference to both FIGS. 1 and 2, a refrigerator 2 includes a cabinet 6 having top, bottom, rear and opposing side panels 8-12. Arranged within cabinet 6 is a fresh food compartment 14 and a freezer compartment 16, with fresh food compartment 14 being arranged above freezer compartment 16 such that refrigerator 2 constitutes a bottom mount style. Fresh food compartment 14 is selectively accessed through a fresh food compartment door 19 adapted to pivot about a vertical axis defined by an upper hinge 21 and a central hinge (not shown). In a manner known in the art, fresh food compartment door 19 is provided with a handle 24. In the embodiment shown, refrigerator 2 includes a drawer 30 (FIG. 2) slidably mounted within a lowermost portion of fresh food compartment 14. Actually, drawer 30 constitutes a crisper bin having a forward/deep portion 33 and a rear/shallow portion 35 which are interconnected through a step portion 37. As shown, step portion 37 slopes upward and rearward from deep portion 33 to shallow portion 35. With this particular configuration, drawer 30 constitutes a bi-level crisper bin providing storage for various sized food articles.

Freezer compartment 16 is constituted by a freezer bin 39 slidably mounted within a lower portion (not separately labeled) of cabinet 6. In accordance with the invention, freezer bin 39 is accessed through a handle 40 that enables a consumer to shift freezer bin 39 from cabinet 6 in order to remove or replace food items contained therein. In a manner that will be detailed more fully below, freezer compartment 16 extends an entire width and depth of cabinet 6 to advantageously provide increased storage capacity for a consumer.

In accordance with a preferred form of the present invention, refrigerator 2 is provided with a freezer drawer 47 arranged between fresh food compartment 14 and freezer compartment 16. In the embodiment shown, freezer drawer 47 includes a front wall 49, rear wall 50, opposing side walls 51 and 52, and a bottom wall 53 that collectively define a storage cavity 54. As best illustrated in FIG. 1, storage cavity 54 is provided with a plurality of adjustable divider walls, one of which is indicated at 55, that can be re-positioned in any one of a plurality of divider supports 57. Divider walls 55 are selectively placed so as to define a plurality of storage zones, such as indicated at 59-61. As will be detailed more fully below, storage zone 59 actually constitutes an ice cube storage bin. In any event, freezer drawer 47 is also shown to include a handle 62 that enables a consumer to selectively access storage cavity 54 in a manner similar to that described above with respect to freezer bin 39.

As best shown in FIG. 2, refrigerator 2 includes an automatic ice maker 70 positioned above freezer drawer 47. In accordance with the most preferred form of the present invention, automatic ice maker 70 is positioned at a rear portion of freezer drawer 70 so as to be located behind an angled section 72 establishing a bottom of fresh food compartment 14. Angled section 72 is arranged to accommodate step portion 37 of crisper bin 30. In this manner, crisper bin 30 can be readily removed or inserted into fresh food compartment 14 without interfering with ice maker 70. In addition, angled section 72 provides the necessary clearance for ice maker 70 and, as will be detailed more fully below, establishes a mechanical zone 86 for housing refrigeration components.

In further accordance with the most preferred form of the present invention, mechanical or refrigeration component mounting zone 86 is arranged behind freezer drawer 47. Mechanical zone 86 provides space for mounting various refrigeration components, such as a compressor 90. By arranging refrigeration components behind freezer drawer 47, freezer compartment 16 can be formed so as to have a substantially rectangular cross-section. In other words, due to the preferred location of the refrigeration component, including compressor 90, there is no need to shorten or, for that matter, shape freezer compartment 16 in such a manner so as to accommodate refrigeration components that would otherwise be arranged in a lowermost portion (not separately labeled) of cabinet 6. Accordingly, freezer compartment 16 does not lose valuable storage space to accommodate the refrigeration components or other features, such as an automatic icemaker.

In still further accordance with the most preferred form of the invention, an evaporator coil 92 is positioned between freezer drawer 47 and freezer compartment 16. More specifically, evaporator coil 92 is arranged below bottom wall 53 and an exposed upper portion (not separately labeled) of freezer compartment 16 to provide cooling to both freezer drawer 47 and freezer compartment 16. At this point, it should be recognized that the particular location of ice maker 70 and the refrigeration components including compressor 90 and evaporator coil 92 advantageously provides consumers with added storage capacity in freezer compartment 16. Moreover, the incorporation of freezer drawer 47 allows consumers to conveniently store often accessed items in an easily accessible area of the refrigerator.

Although described with reference to a preferred embodiment of the present invention, it should be readily apparent to one of ordinary skill in the art that various changes and/or modifications can be made to the invention without departing from the spirit thereof. For instance, the number and location of storage zones in the freezer drawer could vary without departing from the spirit of the present invention. Also, while the freezer compartment is described as a bin shiftably mounted in the cabinet, other configurations, such as providing a door that pivots about a vertical axis, could also be employed. In general, the invention is only intended to be limited to the scope of the following claims.

I claim:

1. A bottom mount style refrigerator comprising:

a cabinet including top, bottom, rear and opposing side walls;

a fresh food compartment positioned within the cabinet;

a bi-level bin shiftably mounted in the fresh food compartment, said bi-level bin including a forward deep portion and a rear, shallow portion joined through a step section;

a fresh food compartment door pivotally mounted relative to the cabinet across the fresh food compartment;

a freezer compartment positioned within the cabinet;

a freezer drawer shiftably mounted relative to the cabinet, said freezer drawer being positioned between the fresh food compartment and the freezer compartment;

an automatic ice maker arranged above the freezer drawer, said automatic ice maker being positioned below the shallow portion of the bi-level bin; and a refrigeration component mounted behind the freezer drawer within the cabinet.

2. A bottom mount style refrigerator comprising:

a cabinet including top, bottom, rear and opposing side walls;

a fresh food compartment positioned within the cabinet;

bin shiftably mounted in the fresh food compartment;

a fresh food compartment door pivotally mounted relative to the cabinet across the fresh food compartment;

a freezer compartment positioned within the cabinet;

a freezer drawer shiftably mounted relative to the cabinet, said freezer drawer being positioned between and separate from the fresh food compartment and the freezer compartment;

an evaporator coil positioned between the freezer drawer and the freezer compartment;

an automatic ice maker arranged above the freezer drawer; and a refrigeration component mounted behind the freezer drawer.

3. The refrigerator according to claim 2, wherein the refrigeration component constitutes a compressor.

4. The refrigerator according to claim 2, further comprising: an evaporator coil, said evaporator coil being positioned between the freezer drawer and the freezer compartment.

5. The refrigerator according to claim 4, further comprising: a plurality of divider walls separating the freezer drawer into a plurality of storage zones.

6. The refrigerator according to claim 5, wherein at least one of the plurality of storage zones constitutes an ice storage bin arranged below the automatic ice maker.

7. The refrigerator according to claim 5, wherein at least one of the plurality of storage zones is constituted by a frozen food storage zone.

8. The refrigerator according to claim 5, wherein the plurality of divider walls are adjustable within the freezer drawer.

9. The refrigerator according to claim 2, wherein the bin is constituted by a bi-level bin shiftably mounted in the fresh food compartment, said bi-level bin including a forward deep portion and a rear, shallow portion joined through a step section.

10. The refrigerator according to claim 9, wherein the ice maker is mounted above the freezer drawer at a position rearward of the step section of the bin.

11. The refrigerator according to claim 2, wherein the freezer compartment is slidable relative to the cabinet, said freezer compartment extending substantially a full width of the cabinet and substantially a full depth of the cabinet.

12. A bottom mount style refrigerator comprising:

a cabinet including top, bottom, rear and opposing side walls;

a fresh food compartment positioned within the cabinet;

a bi-level bin shiftably mounted in the fresh food compartment, said bi-level bin including a forward deep portion and a rear, shallow portion joined through a step section;

a fresh food compartment door pivotally mounted relative to the cabinet across the fresh food compartment;

a freezer compartment positioned within the cabinet;

a freezer drawer shiftably mounted relative to the cabinet, said freezer drawer being positioned between the fresh food compartment and the freezer compartment; and an automatic ice maker arranged above the freezer drawer, said automatic ice maker being positioned below the shallow portion of the bi-level bin.

13. The refrigerator according to claim 12, wherein the freezer compartment is slidable relative to the cabinet, said freezer compartment extending substantially a full width of the cabinet and substantially a full depth of the cabinet.

14. The refrigerator according to claim 12, further comprising: a plurality of divider walls separating the freezer drawer into a plurality of storage zones.

15. The refrigerator according to claim 14, further comprising: an automatic ice maker arranged above the freezer drawer, wherein at least one of the plurality of storage zones constitutes an ice storage bin.

16. The refrigerator according to claim 15, wherein at least one of the plurality of storage zones is constituted by a frozen food storage zone.

17. The refrigerator according to claim 14, wherein the plurality of divider walls are adjustable within the freezer drawer.

18. The refrigerator according to claim 12, further comprising: a compressor for cooling each of the fresh food compartment, the freezer compartment and the freezer drawer, said compressor being mounted between the fresh food compartment and freezer compartment, behind the freezer drawer.

19. The refrigerator according to claim 18, further comprising: an evaporator coil, said evaporator coil being positioned between the freezer drawer and the freezer compartment.

* * * * *